US006446961B1

(12) United States Patent
Foret et al.

(10) Patent No.: US 6,446,961 B1
(45) Date of Patent: Sep. 10, 2002

(54) METHOD AND DEVICE FOR MONITORING THE TRANSPORT OF FLAT COPIES

(75) Inventors: Francoise Marie Foret, Chambly; Dominique Benoit Rousseau; Didier Marcel Rousseau, both of Pont Ste Maxence, all of (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/617,655

(22) Filed: Jul. 17, 2000

(30) Foreign Application Priority Data

Jul. 15, 1999 (DE) ..... 199 33 287
Apr. 6, 2000 (FR) ..... 00 04400

(51) Int. Cl.[7] ..... B65H 7/02
(52) U.S. Cl. ..... 271/259; 271/265.02
(58) Field of Search ..... 271/258.01, 259, 271/265.01, 265.02; 493/405, 416

(56) References Cited

U.S. PATENT DOCUMENTS 3,815,895 A 6/1974 Dufour
4,085,928 A * 4/1978 Sussman
5,034,780 A * 7/1991 Kotabe et al. ..... 271/259 X
5,217,220 A * 6/1993 Carlson et al. ..... 493/416 X
5,262,637 A * 11/1993 Cumberledge et al.
5,273,515 A * 12/1993 Fenske ..... 493/416
5,667,215 A * 9/1997 Yoshino ..... 271/258.01
5,890,708 A * 4/1999 Song ..... 271/259 X

FOREIGN PATENT DOCUMENTS

DE 39 35 056 C2 7/1996
EP 0 753 409 B1 1/1997
EP 0 847 857 A1 6/1998

* cited by examiner

*Primary Examiner*—David H. Bollinger
(74) *Attorney, Agent, or Firm*—Laurence A. Greenberg; Werner H. Stemer; Ralph E. Locher

(57) ABSTRACT

A method of monitoring the transport of flat copies along transport paths in a folder includes selecting sensors for detecting at least one of the presence and the absence of copies, depending upon the folding mode of the folder; determining by transmitters the number of copies that have entered the folder, and comparing the number of copies present in the folder with the number of copies detected by the sensors; a device for performing the method; a folder including the device; and a rotary printing machine in combination with the folder.

16 Claims, 4 Drawing Sheets

100
START
101
SELF TEST
102
DETECT SET FOLDING MODE
103
SENSOR ACTIVATION
104
MEMORY STORAGE
NO
104.1
FAULT DETECTION
YES
105
COUNT COPIES
VALIDATION ROUTINE
NO
106
YES
107
SETTING SENSORS
108
COMPARE NUMBERS OF COPIES
ANY DIFFERENCE IN COMPARISON OPERATION?
NO
109
110
SETTING SWITCH-OFF SIGNAL
NO
YES
PAPER JAM
111
111.1
SENSOR VALIDITY QUERY
SWITCH-OFF COMMAND
112
113
SWITCHING OFF

METHOD AND DEVICE FOR MONITORING THE TRANSPORT OF FLAT COPIES

BACKGROUND OF THE INVENTION

FIELD OF THE INVENTION

The invention relates to a method and a device for monitoring the transport of flat copies, for example copies separated from a material web in a folder and to be folded longitudinally and/or transversely therein.

The published European Patent Document EP 0 847 857 A1 is concerned with an adjusting device of a traversing mechanism disposed upline of a cylinder in a rotary printing machine. On the traversing mechanism, a measuring device is displaceable axially with respect to the circumferential surface of the cylinder by a holder. For adjusting the alignment of the traversing mechanism with respect to the cylinder in a manner that is accurate, uncomplicated and can be automated and has an interchangeable direction of adjustment, the holder can be coupled to an opto-electric auxiliary adjustment device. The auxiliary adjustment device has an optical element that projects a light beam onto the cylinder and at least one optical receiver, which receives a light beam reflected from the cylinder. The optical receiver includes an opto-electronic sensor which, in conjunction with evaluation electronics, is suitable for detecting the position of the reflected light beam on the sensor.

This device is primarily used to align an optical measuring device that scans the surface of the cylinder.

The European Patent 0 753 409 is concerned with a sheet printing machine having a delivery on the upper side of which continuously delivered sheets are to be deposited. It is intended to make possible, in a manner which is simple and does not adversely affect the formation of a sheet pile, the use of a traversing measuring device for scanning a printing control strip applied to the leading edge of the sheets. For this purpose, the measuring device, which is movable on a traversing mechanism, has so-called sheet high-holders assigned thereto, which prevent sheets conveyed while a measuring operation is being performed from being deposited on the upper side of the stack.

With this device from the prior state of the art, however, a conveying path traced by the copies, somewhat through a folder, cannot be detected reliably.

U.S. Pat. No. 3,815,895 discloses a paper-jam detection system for folders which are arranged downline of a web-fed rotary printing system. Photocells disposed within the folder at selected locations detect both copies which are erroneously absent and copies which are erroneously present along the conveying path through the folders. A time-sequence control unit, which operates in synchronism with the folder, generates signals which initiate detection as to whether a copy to be expected at a specific location is actually present there and whether a copy not to be expected at a specific location on the conveying path actually does not arrive at this location. The signals from the photocells are logically linked with those from the time-sequence control unit, and fed to a logic circuit which, if necessary or desirable, stops the folder. The system also detects a failure of one of the photocells in the paper-jam detection system.

It has been found that not only paper jams which occur at full operating speed in a web-fed rotary system cause drastic consequences in the folder and long down times of a rotary printing machine, but also, paper jams which occur even during the threading of the web or at creep speed of the rotary printing machine, or due to misguiding the paper can at least cause avoidable delays during run-up or acceleration of the rotary printing machine. During the threading of the web or at creep speed of the rotary printing machine, very high torques can occur, mechanical settings of grippers, cylinders or similar components in relation to one another can be indefinite, while the attention of the pressman can be directed to other work necessary within the context of a new job set-up.

SUMMARY OF THE INVENTION

It is accordingly an object of the inventions to provide, in accordance with the invention and in view of the outlined advancements in the prior art and the indicated technical problems, a device for monitoring the transport of flat copies or, in other words, a paper-run monitoring system, which is responsive to irregularities in the copy transport at slow paper conveyance speeds.

With the foregoing and other objects in view, there is provided, in accordance with one aspect of the invention, a method of monitoring the transport of flat copies along transport paths in a folder, which comprises selecting sensors for detecting at least one of the presence and the absence of copies, depending upon the folding mode of the folder; determining by transmitters the number of copies that have entered the folder, and comparing the number of copies present in the folder with the number of copies detected by the sensors.

In accordance with another mode, the method of the invention includes validating the sensors based upon the progression of the copies along the transport paths, in accordance with the folding mode of the folder.

In accordance with a further mode, the method of the invention includes performing a validation, at the start of the transport of the copies through the folder, by sensors upland to the transport start, after a few copies have been conveyed to the folder.

In accordance with an added mode, the method of the invention includes performing a validation of sensors disposed farther downline along the transport path than the first-mentioned sensors, after a large number of copies have been transported into the folder.

In accordance with an additional mode, the method of the invention includes assigning a transmitter to a cylinder, and determining by the transmitter the number of copies transported into the folder.

In accordance with yet another mode, the method of the invention includes determining the number of copies transported into the folder, by a transmitter assigned to a drive of the folder.

In accordance with yet a further mode, the method of the invention includes transmitting the determined number of copies to a monitoring and evaluation unit.

In accordance with yet an added mode, the method of the invention includes, in accordance with a selected folding mode of the folder, determining for each sensor the ratio between the number of copies that have entered the folder and the number of copies respectively counted at the sensor position.

In accordance with yet an additional mode, the method of the invention includes, for each sensor position, determining a maximum permissible difference between the number of copies that have entered the folder and the number of copies that have actually appeared at the position of the respective sensor.

In accordance with still another mode, the method of the invention includes performing the validation of the respective sensors based upon the attainment of a minimum number of conveyed copies at the respective position of the sensors.

In accordance with still a further mode, the method of the invention includes performing the comparison between the theoretical number of copies and the number of copies actually detected for each sensor position in real time.

In accordance with another aspect of the invention, there is provided a device for performing a method of monitoring the transport of flat copies along transport paths in a folder, comprising sensors grouped as sensor pairs, respectively, having a transmitting part and a receiving part.

In accordance with another feature of the device of the invention, at least one of the material web and the copies are conveyable in a conveying plane, and the receiving and transmitting parts of the sensors are arranged on opposite sides of the conveying plane.

In accordance with a further feature of the device of the invention, the transmitting part is formed as a proximity switch.

In accordance with an added feature of the invention, the device includes a transmitter assigned to a drive of the folder and formed as a rotary encoder.

In accordance with an additional feature of the device of the invention, a then current folding mode of the folder is determinable by the position of the folding components on a paper-carrying cylinder, and further included is a monitoring unit to which the then current folding mode is transmittable.

In accordance with another aspect of the invention, there is provided a folder for a rotary printing machine, for processing material webs, the folder being capable of operating in at least two folding modes, and having its own drive, comprising a monitoring unit, by which, in accordance with a respectively selected folding mode, copy conveying paths are able to be validated by respective sensors assigned to the copy conveying paths, based upon progressions of the copies through the folder, and the number of the copies present in the folder are able to be compared with the number of copies that have entered the folder.

In accordance with a concomitant aspect of the invention, there is provided a rotary printing machine having a folder that is capable of operating in at least two folding modes, and having its own drive, comprising a monitoring unit, by which, in accordance with a respectively selected folding mode, copy conveying paths are able to be validated by respective sensors assigned to the copy conveying paths, based upon progressions of the copies through the folder, and the number of the copies present in the folder are able to be compared with the number of copies that have entered the folder.

The advantages that can be achieved by the foregoing modes and features of the invention are many and varied. Thus, by using the method according to the invention, folders can be incorporated significantly faster into the paper run at creep speed of the upline rotary printing machine, because misrouted copies in the folder can be detected immediately and can lead to the folder drive being switched off. This constitutes an effective safeguard for mechanical folding components which are installed in an, as yet, undefined way in relation to one another and which, at creep speed, could be considerably damaged by the high torques occurring thereat. Both at creep speed of the rotary system and also during the paper threading phase, the pressmen can devote their attention to further necessary pre-settings, an incipient paper jam or the misrouting of a copy will then be detected automatically.

In a further refinement of the method upon which the invention is based, sensors in the folder are validated, based upon the progression of the copies along the conveying path, depending upon the folding mode of the folder. The validation, i.e., the declaration of validity of a sensor signal, which can be performed electronically, in the case of the sensors located at the start of the copy conveying path, is carried out only after a few copies have entered the folder, after which the relevant sensor can detect a copy at the very earliest, in accordance with the folding mode set with the preselected transport path. The validation of sensors arranged earlier in the copy transport path is carried out after a lower, pre-settable number of copies, while the validation of sensors arranged later in the copy transport path is carried out after a larger number of copies have entered the folder, corresponding to the distance extending as far as the validating sensor.

The limiting values which permit the validation can be predefined at the monitoring unit and stored there, so that they are always currently available for the necessary calculations.

The validation of the sensors corresponding to the selected folding mode along the conveying path of the copies that is associated with the folding mode ensures the reliability of the signals transmitted by the sensors to the monitoring unit. The determination of the number of copies which have entered the folder is carried out, for example, by transmitters assigned to the cutting cylinders or revolution counters assigned to the drive motor of the folder. Depending upon the selected length of the cut, it is thus possible for the number of copies transported into the folder to be determined individually.

In the monitoring unit, according to the method of the invention, the difference between the number of copies detected for each validated sensor and the number of copies located in the folder is determined continuously, it being possible for a maximum permissible difference to be predefined at the monitoring unit. This difference can be predefined in accordance with or based upon the printing material parameters, copy thickness and values from experience, in order to set up the monitoring system suitably for the job.

The sensors required in order to perform the method according to the invention are preferably pairs of sensors which comprise a transmitting and a receiving part. These are spaced apart from one another, with the conveying path of the copies running between the transmitting and receiving parts. The transmitters assigned to the cutting cylinders or the drive of the folder can be configured, for example, as proximity switches or encoders, such as rotary encoders, which for each revolution of the relevant unit transmit a counting pulse to the monitoring unit, the pulses being added therein.

By the modes and features of the invention, it is preferably possible to monitor folders which are arranged downline of a web-fed rotary printing machine, the monitoring unit validating the sensors required in accordance with the copy conveying path necessary for the selected folding mode, and the sensor signals, validated in this way, for the number of copies being compared with that number which has entered the folder. From this comparison, performed in real time, a switch-off condition in the folder and/or for the entire rotary printing machine can be derived.

Other features which are considered as characteristic for the invention are set forth in the appended claims.

Although the invention is illustrated and described herein as embodied in a method and device for monitoring the transport of flat copies, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
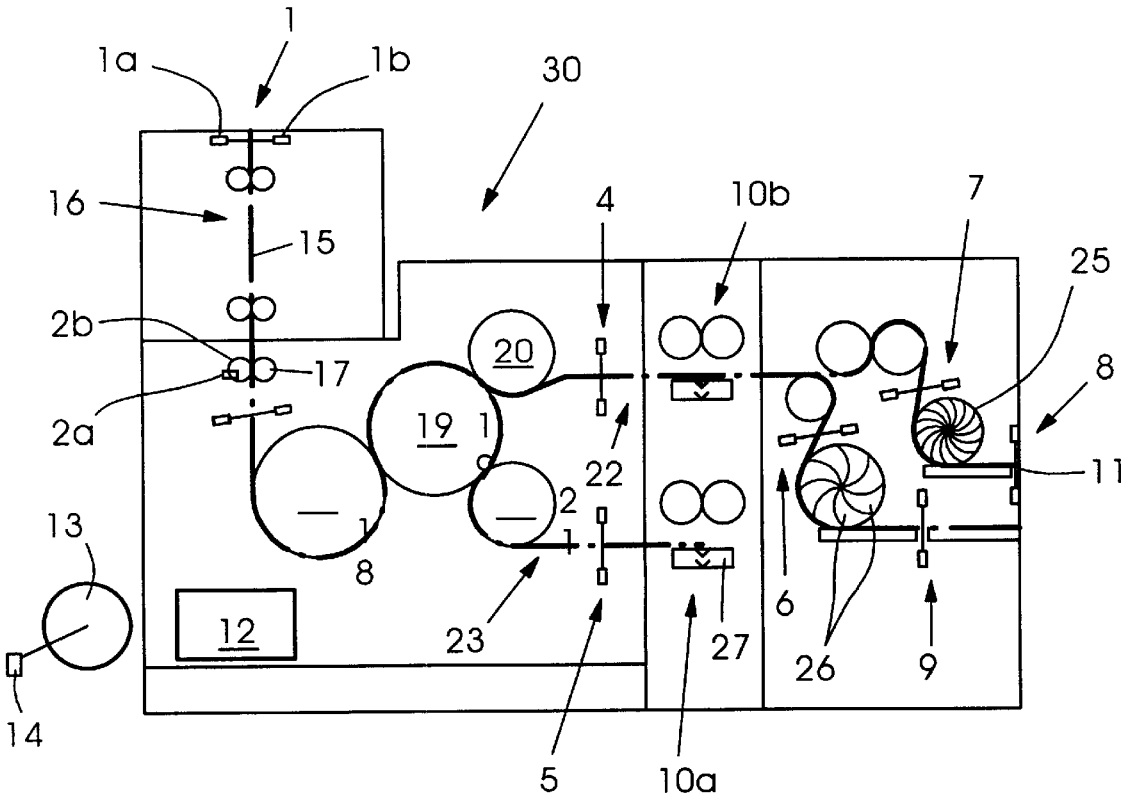
FIG. 1 is a diagrammatic view showing the basic construction of a folder with pairs of sensors assigned to the respective copy conveying path.

Referring now to the drawings and, first, particularly to FIG. 1 thereof, there is illustrated therein the basic construction of a folder with pairs of sensors assigned to the respective copy delivery paths.

A material web 15, which can also be formed of a number of layers of material web, after passing through a turner-bar superstructure not otherwise specifically illustrated in the drawings, enters the folder 30, having already been provided with a first longitudinal fold. The presence of the material web 15 is detected by a pair of sensors 1, which include a transmitting and a receiving part 1*a* and 1*b*, respectively. The material web 15 transported in the conveying plane 16 passes through a cutting-cylinder pair 2*b*, 17 including a cutting cylinder 2*b* and a grooved cylinder 17 cooperating therewith. The individual copies are separated thereat from the material web 15 by cross-cutting the latter.

The cutting cylinder 2*b* can optionally have a transmitter 2*a* assigned thereto which, for each revolution of the cutting cylinder 2*b*, transmits a counting pulse to a monitoring unit 12. For each revolution of the cutting cylinder 2*b*, precisely one copy is separated from the leading end of the material web 15, as a result of which the number of copies present in the folder 30 can easily be determined. Alternatively, the number of copies which have entered the folder 30 can be determined via a rotary encoder 14, which registers the revolutions of the drive motor 13 that drives the folder 30, based upon which, likewise the number of copies that have entered the folder can be determined. The values for the copies entering the folder which are obtained in this manner are determined continuously and stored in the monitoring unit 12.

The further transport of the copies is then monitored by a pair of sensors 3 assigned to a folding-blade cylinder 18. The folding-jaw cylinder 19 operates together with the folding-blade cylinder 18, the first crossfold on the copy being formed between these two cooperating cylinders 18 and 19. The folding-jaw cylinder 19 has two further transport or gripper cylinders 20 and 21 assigned thereto which, on the one hand, form a further crossfold in the copy and, on the other hand, alternately pick up the copies from the circumference of the folding-jaw cylinder 19 and, in this way, effect the division of the copy stream.

Downline of the upper transport cylinder 20, there extends an upper conveying path 22, safeguarded by a pair of sensors 4, which continues to an upper second longitudinal folding device 10*b*. In a manner analogous thereto, a lower conveying path 23 is assigned to the lower transport cylinder 21, likewise safeguarded by a pair of sensors 5, the copies being fed via a lower conveying path 23 to a further second longitudinal folding device 10*a*. The two second longitudinal folding devices 10*a* and 10*b*, respectively, include a respective folding blade 27, which forms the folded spine on the copy by pushing it in between folding rollers, otherwise not specifically illustrated in the drawings. The double circles located above the respective folding blades 27 are supposed to indicate the drive to the folding blades 27 in simplified form.

Connected downline of the upper second longitudinal folding module 10*b* is a paddle-wheel configuration 25, 26, it being possible both for each paddle wheel 25 and 26 to monitor the entry of the copies by respective sensor pairs 7 and 6, and also to monitor the copies leaving the paddle wheels 25 and 26 by sensor pairs 8 and 9, respectively. At the outlet 11, the copies, laid out in imbricated or overlapping formation, leave the folder 30 in order to be fed to a stacker or a packaging machine for further processing.

Figure 2:
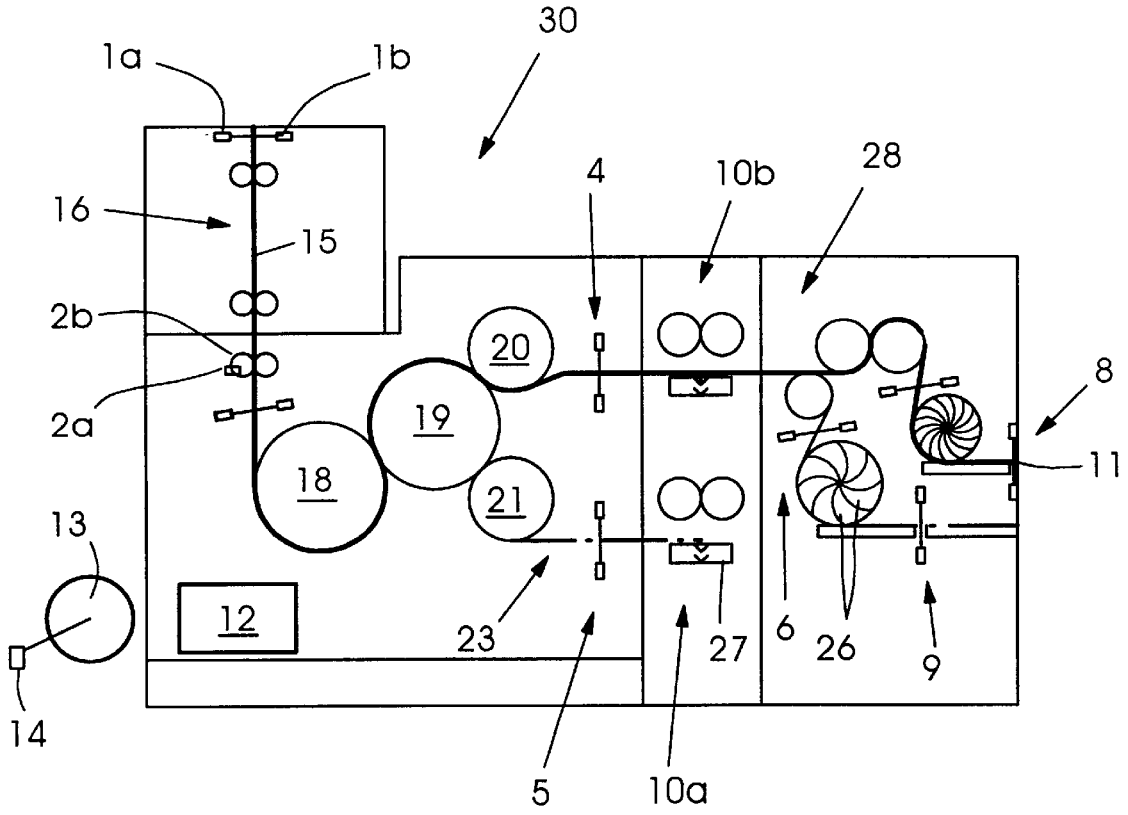
FIG. 2 is a view like that of FIG. 1 showing copy being conveyed through the folder in a manner corresponding to that of the double parallel folding mode.

FIG. 2 shows copy transport through the folder corresponding to the double parallel folding mode.

The conveying path 28 reproduced in FIG. 2 with a very bold line thickness indicates the transport path which the copies, separated from the material web 15 by the cutting-cylinder pair 2b, 17, assume in the double parallel folding mode. In this operating mode of the folder 30, the copies are double-parallel folded by the mutually cooperating folding cylinders 18, 19 and 20. The copies are conveyed along the upper conveying path 22, the upper second longitudinal folding device lob being inactive and permitting the cross-folded copies to pass. The latter can then be routed optionally into a lower paddle wheel 26 or an upper paddle wheel 25, by which then an overlapping or imbricated output of the copies can be performed. In this folding mode, which necessitates the transport of the copies according to the conveying path 28, the sensor pairs 3, 4, 6, 7, 8 and 9 are switched to detection mode, while the sensor pair 5 on the lower conveying path 23 has to be switched in such a way that this pair has to detect the absence of copies. Depending upon the selected output configuration for the copies in the double parallel folding mode, one of the paddle wheels 25 or 26 or both paddle wheels can perform the product output. In the event that copies are output via the upper paddle wheel 25, the sensors 7 and 8 have to be switched to detection mode, after appropriate validation, while the sensor pairs 6 and 9 would have to be set to detect the absence of copies.

The sensors 7 and 8 in the paddle-wheel module of the folder 30 are validated in that they detect a copy very early, and output a valid signal when a number of copies corresponding to the distance from the cutting cylinder pair 2*b*, 17 to the respective sensor is located in the folder 30. This applies in a similar way to the sensors 6 and 9, if product output via the lower paddle wheel 25 is also provided.

The validation of the sensors 3, 4, 7 and 8 and, if necessary, 6 and 9 is performed based upon the progression of copies through the folder 30, so that the signals from the sensors are viewed as valid only when the respective sensor can detect or not detect a copy very early, depending upon the folding mode.

Figure 3:
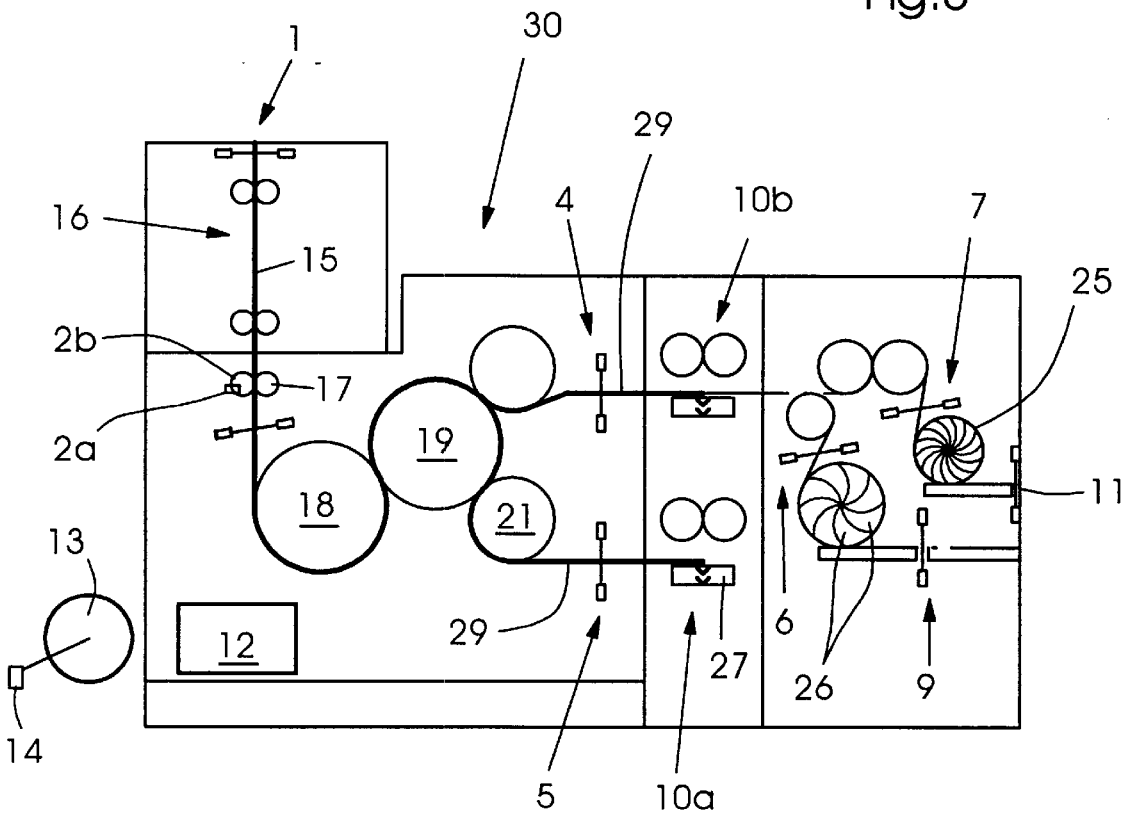
FIG. 3 is another view like that of FIG. 1 showing copy transport through the folder in a manner corresponding to that of the second longitudinal folding mode, with a dividing copy stream.

FIG. 3 illustrates a copy conveying path corresponding to the second longitudinal folding mode, the copy stream dividing downline from the folding-jaw cylinders.

In this operating mode of the folder 30, the copy conveying paths of which are identified by reference numeral 29, the copies are crossfolded once downline of the folding-jaw cylinder 19, picked off alternately by the cylinders 20 and 21 and pass via the upper and the lower conveying paths 22 and 23, respectively, into the upper and the lower second longitudinal folding devices 10*b* and 10*a*, respectively. Thereat, the crossfolded copies are provided with a second longitudinal fold and pass into an otherwise not specifically illustrated delivery in FIG. 3.

In this operating mode of the folder 30, the paddle-wheel module is inactive, and consequently the sensors provided thereat are inactive, i.e., switched to detect the absence of copies; on the other hand, the sensor pairs 3, 4 and 5 assigned to the conveying path 29 of the copies are switched to detect the presence of the copies, but under the condition that a validation of the copies detected by the sensor pairs 3, 4 and 5 can be performed only after the times at which the respective sensor pairs 1, 3, 4 and 5 can at the earliest detect a copy in accordance with the progression of copies through the folder.

In the configuration according to FIGS. 2 and 3, the number of copies that have entered the folder 30 can be determined via transmitters 2*a* and 14, which are assigned to the cutting cylinder 2*b* or the drive 13 of the folder 30, as already described above.

Figure 4:
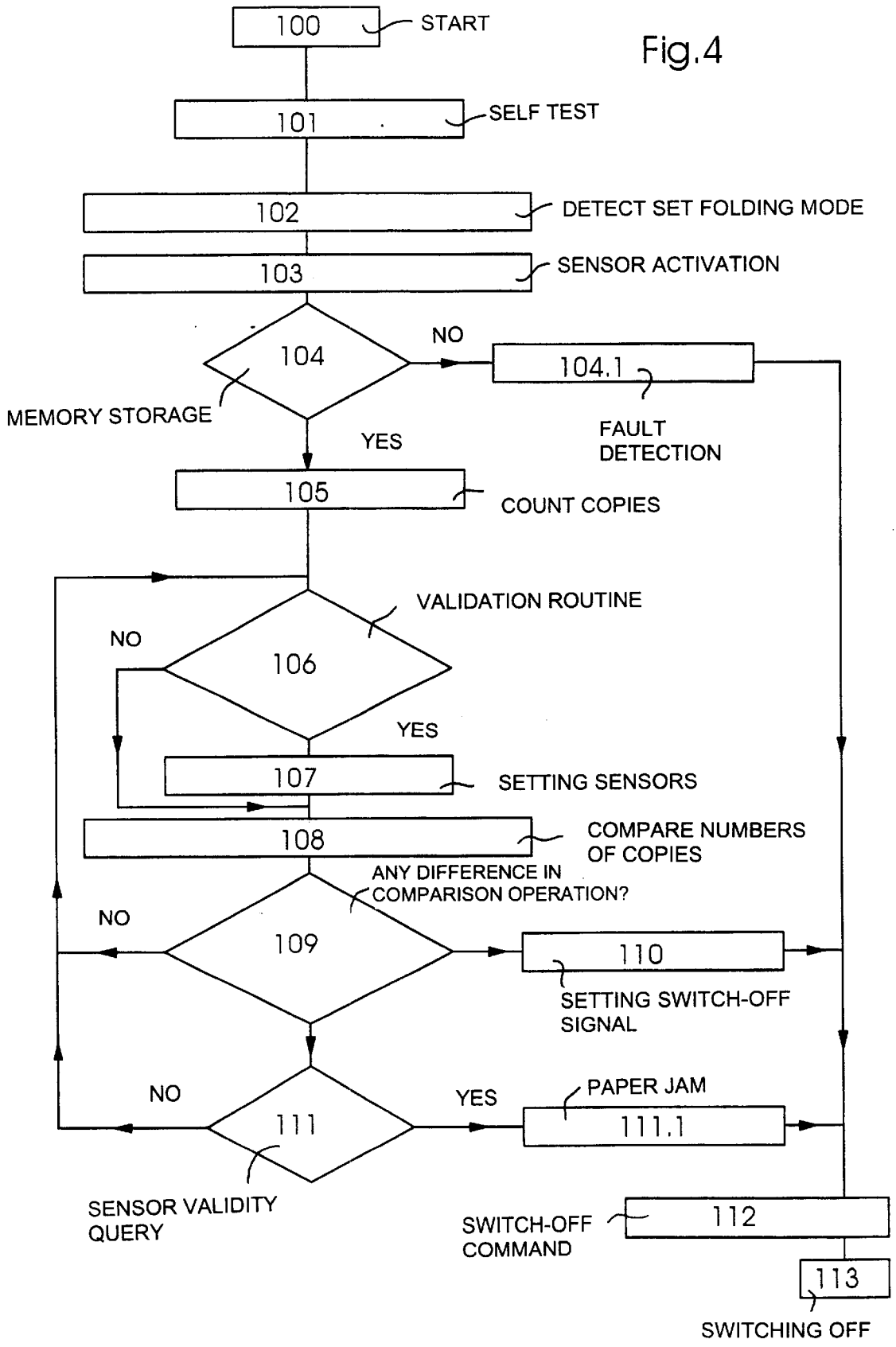
FIG. 4 is a basic flow chart reproduced in relatively simplified form and clarifying the mode of operation of the control unit.

The functioning of the monitoring unit 12 integrated into the folder 30 and illustrated by FIGS. 1 to 3 may best be explained by using the flow chart according to FIG. 4.

With the starting command 100, initialization of the monitoring unit 12 is carried out, the latter first carrying out a self-test 101 and indicating its activation to the pressman by a visual or an acoustic device. In accordance with the predefined folder configuration, the set folding mode, for example double parallel fold 28 or second longitudinal folding mode 29, is detected; this is carried out in step 102; depending upon the selected folding mode 28 or 29, the sensor activation 103 activates the sensors 3, 4, 5, 6, 7, 8 or 9 which are located on the delivery path of the copies through the folder 30 corresponding to the selected folding mode 28 or 29. These are stored in the memory 104, with which a fault detection routine 104.1 is associated.

If the relevant sensors from the number of sensors 3, 4, 5, 6, 7, 8 or 9 have been activated and stored, the number of copies that have entered the folder 30 is determined in the counting stage 105.

The following part of the diagram, between the counting stage 105 and the validation routine 106, is carried out separately for each sensor 3, 4, 5, 6, 7, 8 or 9, because each of these sensors has a different validation threshold by virtue of its different positions in the folder 30. After the respective validation threshold has been exceeded, at the time from which the selected sensor can at the earliest detect a copy or can detect the lack of the copy, the corresponding sensor signal is for the first time recognized as a valid sensor signal; this is carried out by setting the sensors in 107.

After that, depending upon the folding mode of selected sensors, a comparison operation 108 is carried out between the number of copies located in the folder 30 and the number of copies detected at the respective sensor. If the result is that there is no difference in the comparison operation 109, which is carried out in real time, once again a branch is made to the signal validity query 106, in order to check whether the validation threshold has actually been exceeded or not.

If the result of the comparison 109 is that more copies have been counted at the respective sensor than can have entered the folder, the folder 30 and/or the rotary printing machine are stopped by setting the switch-off signal 110, because there could be a malfunction of the transmitters 2*a* and 14.

If, on the other hand, the result of the comparison operation 109 is a lower number of copies detected by the sensors 3, 4, 5, 6, 7, 8 or 9 than have entered the folder 30, it is first determined, via a sensor validity query 111, whether this result was produced by a previously validated sensor. If a non-validated sensor is concerned, a branch back to the validation query 106 is made; if, on the other hand, the corresponding sensor had been correctly validated, it is determined that there was a paper jam 111.1, which uses a switch-off command 112 to bring about the action of switching off the drive 13 of the folder 30 and/or of the rotary printing machine. When the command 113 is reached, the monitoring unit 112 has run through the program that controls the monitoring.

After the monitoring system has been initialized, it indicates to the pressman that it has been activated at creep speed or during the web threading phase. The system is capable of monitoring itself in such a way that, if at a sensor a number of copies is detected which is greater than the number of copies that has actually entered the folder 30, the functional monitoring of the rotary encoder 2*a* or 14 is indicated. The monitoring system can be used in any folder and, in addition to detecting copy jam at creep speed or during web threading, it is also suitable and can be configured appropriately for normal operating speeds.

We claim:

1. A method of monitoring the transport of flat copies along transport paths in a folder, which comprises:

providing sensors for detecting at least one of the presence and the absence of copies;

selecting some of the sensors to detect the presence of copies and others of the sensors to detect the absence of copies depending upon folding modes of the folder;

determining by transmitters the number of copies that have entered the folder; and comparing the number of copies present in the folder with the number of copies detected by the sensors.

2. The method according to claim 1, which includes validating the sensors based upon the progression of the copies along the transport paths, in accordance with folding mode of the folder.

3. The method according to claim 2, which includes performing a validation, at the start of the transport of the copies through the folder, of sensors disposed upline to the transport start, after a few copies have been conveyed to the folder.

4. The method according to claim 3, which includes performing a validation of sensors disposed farther downline along the transport path than the sensors disposed upline, after a number of copies larger than the few copies have been transported into the folder.

5. The method according to claim 3, which includes performing the validation of the respective sensors based upon the attainment of a minimum number of conveyed copies at the respective position of the sensors.

6. The method according to claim 1, which includes assigning a transmitter to a cylinder, and determining by the transmitter the number of copies transported into the folder.

7. The method according to claim 6, which includes transmitting the determined number of copies to a monitoring and evaluation unit.

8. The method according to claim 1, which includes, for each selected folding mode of the folder, differently determining for each selected sensor the ratio between the number of copies that have entered the folder and the number of copies respectively counted at the sensor position.

9. The method according to claim 1, which includes, in accordance with a selected folding mode of the folder, determining for each sensor the ratio between the number of copies that have entered the folder and the number of copies respectively counted at the sensor position.

10. The method according to claim 1, which includes, for each sensor position, determining a maximum permissible difference between the number of copies that have entered the folder and the number of copies that have actually appeared at the position of the respective sensor.

11. The method according to claim 1, which includes performing the comparison between a predetermined number of copies and the number of copies actually detected for each sensor position in real time.

12. A device for performing a method of monitoring the transport of flat copies along transport paths in a folder including at least one paper-carrying cylinder and folding components on the at least one paper-carrying cylinder, comprising:

sensors disposed along the transport paths, the sensors being grouped as sensor pairs, respectively, having a transmitting part and a receiving part; and a monitoring unit integrated into the folder for monitoring folding modes.

13. The device according to claim 12, wherein at least one of a material web and the copies are conveyable in a conveying plane, and said receiving and transmitting parts of said sensors are arranged on opposite sides of said conveying plane.

14. The device according to claim 13, wherein said transmitting part is formed as a proximity switch.

15. The device according to claim 12, including a transmitter assigned to a drive of the folder, said transmitter including a rotary encoder.

16. The device according to claim 12, wherein a then current folding mode of the folder is determinable by a position of the folding components, and is transmittable to said monitoring unit.

* * * * *